United States Patent [19]

Kanamaru et al.

[11] 4,370,793

[45] Feb. 1, 1983

[54] METHOD OF COUPLING TWO METALLIC MEMBERS

[75] Inventors: Hisanobu Kanamaru, Higashiishikawa; Moisei Okabe, Tokyo; Hideo Tatsumi, Sumiyoshi; Akira Tohkairin, Tahiko, all of Japan

[73] Assignee: Hitachi, Ltd., Tokyo, Japan

[21] Appl. No.: 109,266

[22] Filed: Jan. 3, 1980

[30] Foreign Application Priority Data

Jan. 10, 1979 [JP] Japan ..... 54-699

[51] Int. Cl.[3] ..... B23P 11/02; B21D 39/00; B23P 11/00; B23P 14/02

[52] U.S. Cl. ..... 29/446; 29/520; 29/522 R; 29/DIG. 23; 29/243.52; 29/281.3; 403/274; 72/402

[58] Field of Search ..... 29/509, 520, DIG. 23, 29/522 R, 446, 243.52, 281.3; 403/274; 72/402

[56] References Cited

U.S. PATENT DOCUMENTS

| | | | |
|---|---|---|---|
| 913,618 | 2/1909 | Butler | 29/520 UX |
| 1,067,362 | 7/1913 | Miller | 29/520 X |
| 2,517,598 | 8/1950 | Rehnberg et al. | 72/402 |
| 2,537,723 | 1/1951 | Ward | 29/520 UX |
| 2,840,113 | 6/1958 | Simpson et al. | 29/520 X |
| 3,000,420 | 9/1961 | Spokes | 29/520 X |
| 3,100,333 | 8/1963 | Friend | 29/520 UX |
| 3,103,833 | 9/1963 | Lejdegard | 72/402 X |
| 3,399,705 | 9/1968 | Breed et al. | 29/509 X |
| 4,043,173 | 8/1977 | Marciniak et al. | 72/402 X |
| 4,125,298 | 11/1978 | Heurich et al. | 29/520 X |
| 4,187,597 | 2/1980 | Bremer, Jr. | 29/243.52 X |

FOREIGN PATENT DOCUMENTS

| | | | |
|---|---|---|---|
| 681998 | 3/1964 | Canada | 29/520 |
| 1777114 | 8/1958 | Fed. Rep. of Germany . | |
| 132407 | 9/1978 | Fed. Rep. of Germany . | |
| 296233 | 8/1928 | United Kingdom . | |
| 297570 | 9/1928 | United Kingdom . | |
| 436706 | 10/1935 | United Kingdom . | |
| 703786 | 2/1954 | United Kingdom . | |
| 1286385 | 8/1972 | United Kingdom . | |

*Primary Examiner*—Charlie T. Moon

*Attorney, Agent, or Firm*—Antonelli, Terry and Wands

[57] ABSTRACT

A method and apparatus for coupling two metallic members such as a shaft and a disc. The method includes forming an annular groove on a joint face or outer circumference of the metallic member having greater deformation resistance of the two members, for example, forming uneven portions on the bottom of the groove by knurling or the like. Working the other metallic member, for example, the disc; having smaller deformation resistance near its joint face so that the joint face opposing that of the other causes plastic deformation. Causing a part of the disc to fluidize and flow into the groove, thereby coupling both metallic members together.

21 Claims, 14 Drawing Figures

METHOD OF COUPLING TWO METALLIC MEMBERS

BACKGROUND OF THE INVENTION

This invention relates to a method and apparatus for directly coupling two metallic members such as a shaft and a disc, and more particularly to a method and apparatus for directly coupling two metallic members rotary equipment for enabling a transmitting of large torques.

As a direct coupling method of two metallic members such as a shaft and a disc, there has been proposed a press-in method in which the shaft is pressed into the hollow portion of the disc and so coupled. However, this method has its limits in bonding power and can not be adapted to the application in the field where magnitude of the torque fluctuates drastically. There has been another proposed press-in method in which knurling is in advance applied around the outer circumference of the shaft to increase the bonding power and shaft is then pressed into the hollow portion of the disc. According to this method, however, the hollow portion of the disc and portions nearby tend to be cut off by the crests of knurling or to cause work hardening. Consequently, the disc can not be inserted sufficiently into the knurled portion of the shaft, thereby failing to obtain large shear strength. One disadvantage resides in the fact that, if the portion of the disc near its hollow portion is cut off, it becomes difficult to align the axis of the disc with that of the shaft. Another disadvantage resides in the fact that, if the press force is increased in order to increase the bonding power, the shaft is apt to be bent disadvantageously.

SUMMARY OF THE INVENTION

It is therefore a primary object of the present invention to provide a method of directly coupling two metallic members on the joint face which provides sufficiently high bonding power.

The present invention is characterized by the steps of forming an annular groove on the joint face of a first metallic member, forming uneven portions on the bottom of the groove by knurling or the like, providing the joint face on a second metallic member to engage with the joint face of the first metallic member, cold-working the portion of the second metallic member near the joint face to cause plastic deformation and fluidizing the portion so as to flow into the groove.

DESCRIPTION OF THE PREFERRED EMBODIMENTS

Figure 1:
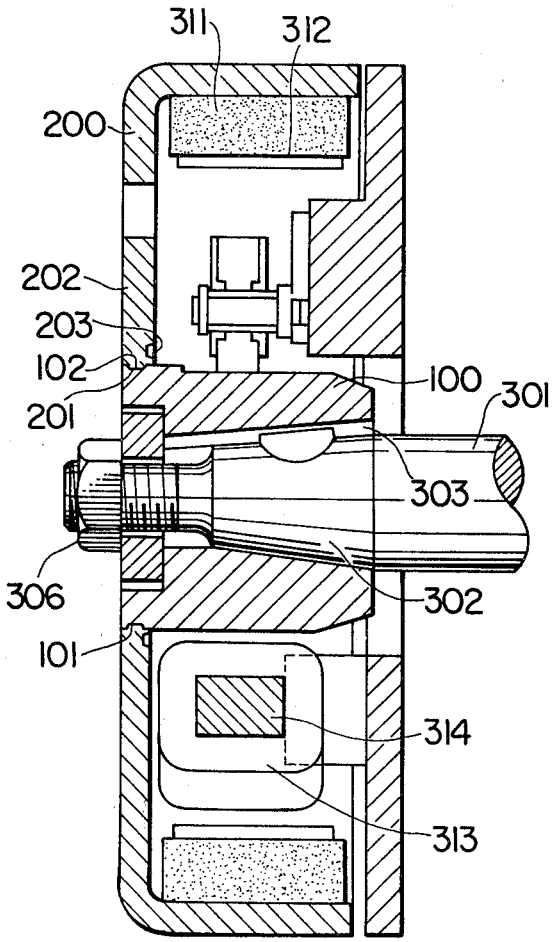
FIG. 1 is a longitudinal sectional view showing the principal portions of the flywheel magnet.

Referring now to the drawings when like reference numerals are used throughout the various views to designate like parts and, more particularly, to FIG. 1, according to this figure, a driving shaft 301 of an engine includes a tapered portion 302 is formed at one end of the shaft 301. A hollow boss 100, whose material is a structural carbon steel, that is, ASPM 570 (A-E) 75 is secured to the driving shaft 301 by means of a key 303 and a nut 306.

A cup-like flywheel core 200 is formed of a mild steel, that is, ASPM 1038. Permanent magnets 311 and magnetic poles 312 are disposed alternately and radially around the circumference of the core 200, and an inner face of each pole 312 faces, with a clearance, a stator core 314 on which a generating coil 313 is wound.

The core 200 is directly coupled to the boss 100. Hence, the driving shaft 301 and the core 200 are integrated with each other and the flywheel core 200 rotates together with the driving shaft 301.

Next, the explanation will be made about a coupling method of the core 200 and the boss 100.

Figure 2:
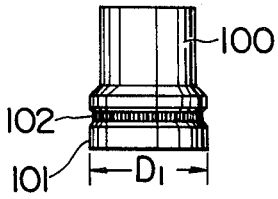
FIG. 2 is a side view of the boss of FIG. 1 before coupling.

As shown in FIG. 2 the boss 100, before coupling, is provided with an annular groove 102 on a joint face 101 of the boss 100 and knurling is applied to the bottom of the groove 102.

Figure 3A:
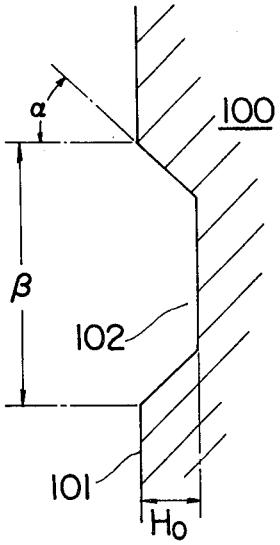
FIG. 3A is an enlarged longitudinal cross-sectional detailed view of a groove portion provided in the boss of FIG. 2.

As shown in FIG. 3A, the annular groove 102 before knurling has a width B and a depth which are suitably selected in accordance with the shear strength required for the joint portion in the axial direction. The depth $H_0$ of the groove 102 is preferably from 0.2 to 1.0 Omm. Even if the depth of the groove 102 is excessively increased, such increase does not much contribute to the increase in the bonding power. The angle of inclination $\alpha$ on the side face of the groove 102 is from 30° to 70°, preferably about 45°.

Figure 3B:
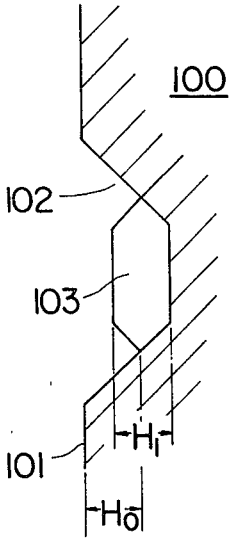
FIG. 3B is an enlarged, longitudinal cross-sectional view of the groove portion of the boss of FIG. 2 after knurling is applied to the groove.
Figure 4:
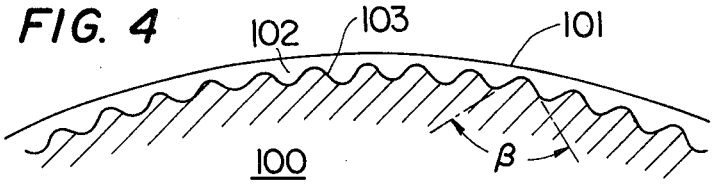
FIG. 4 is an enlarged, transverse sectional view of the groove portion of the boss in FIG. 2.

As shown in FIGS. 3B and 4, a continuous uneven portion 103 is formed on the bottom of the groove 102 by knurling. The height $H_1$ of the uneven portion 103 is from 0.2 to 1.0 Omm and its face angle $\beta$ is from 60° to 120°, preferably about 90°. It is preferred that the apex of the uneven portion 103 does not protrude outwardly beyond the joint face 101.

Figure 5:
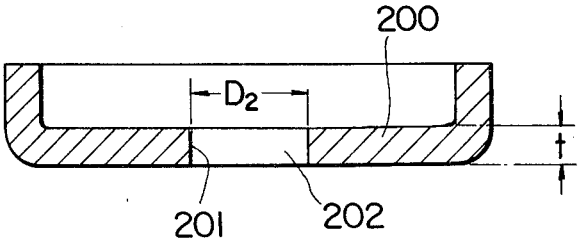
FIG. 5 is a longitudinal cross-sectional view of the flywheel core before coupling.

On the other hand, as shown in FIG. 5, the cup-like flywheel core 200 is provided with a hollow portion 202 having a joint face 201. The joint face 201 has a t which is considerably greater than the groove width B of the boss 100. The relationship between the diameter $D_2$ of the hollow portion 202 and the diameter $D_1$ of the joint face 101 of the boss 100 is selected such that the boss 100 can be inserted gently into the hollow portion 202 of the core 200, that is to say, the boss 100 is brought into sliding contact or into idle engagement at the time of insertion. If $D_2$ is much greater than $D_1$, it becomes difficult to couple the boss 100 and the core 200 with their axes being in conformity with each other. On the other hand, if $D_2$ is smaller than $D_1$, it becomes necessary to press in the boss 100 before coupling whereby workability is lowered.

Figure 6:
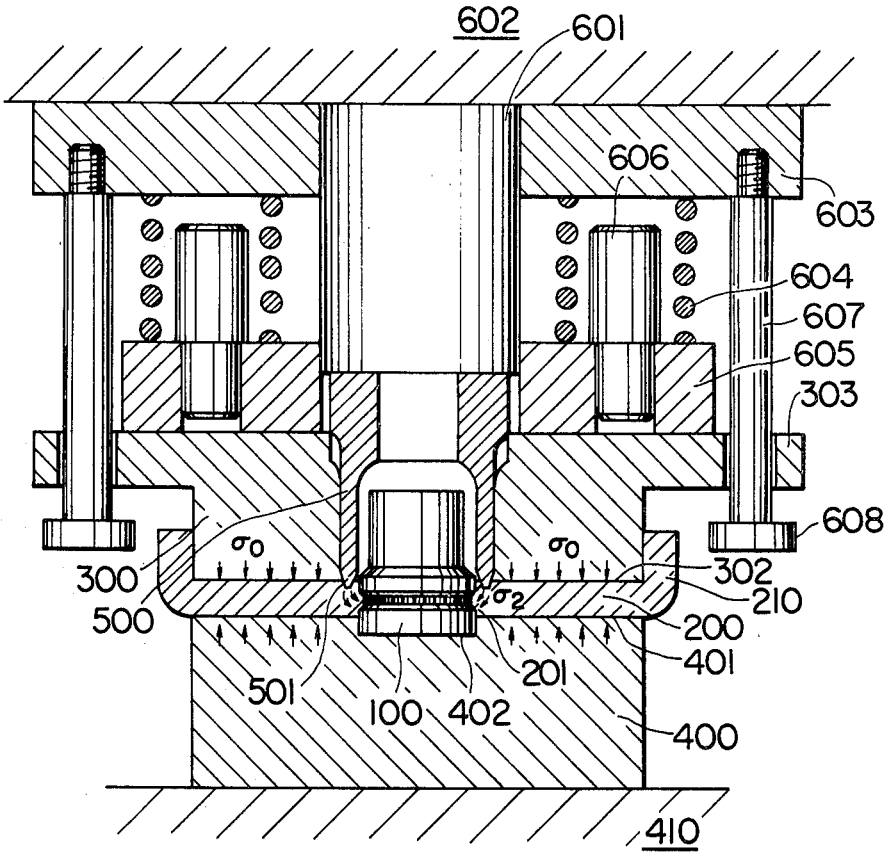
FIG. 6 is a cross-sectional view of the apparatus for coupling the boss to a flywheel core.

FIG. 6 provides an example of an apparatus for carrying out the coupling steps of the present invention and, according to this figure, the core 200 is held on a flat face portion 401 of a lower mold 400 of a press machine. Next, the boss 100 is inserted into the core hollow portion 202 and is supported by a recess 402 of the lower mold 400 fitted onto a bolster 410. A male mold 500 is disposed at the hollow portion of an upper keeper plate 300 with a male mold seat 601 being interconnected to a slide 602 of the press machine.

An upper spring support 603, a spring 604, a lower spring support 605 and a spring guide 606 are interposed between the slide 602 and the upper keeper plate 300. The upper spring support 603 is secured to the slide 602.

The upper keeper plate 300 is supported by the upper spring support 603 at the portion of its arm 303 via a bolt 607.

The coupling is effected by cold forming and, for this purpose, the male mold seat 601, the male mold 500 and the upper keeper plate 300 descend along with lowering of the slide 602. Since there is a gap between the arm 303 of the upper keeper plate 300 and the head 608 of the bolt 607, the end face of the core 200 is pressed by the flat face portion 302 of the upper keeper plate 300 before it is pressed by the male mold 500. This press force is applied from a direction right-angled to the end face of the core 200 from the slide 602 via the upper spring support 603 and the spring 604.

As a consequence of the application of the pressing force, prestress $\rho_0$, designated by the arrows in FIG. 6, acts on the core 200 in the direction at right angles to the flat face 302 of the upper keeper plate 300 and flat face portion 401 of the lower mold 400. This prestress $\rho_0$ is considerably smaller than the lower limit of the stress for the plastic deformation of the material of the core 200, that is, less than the deformation resistance $\rho_1$.

When the apparatus is in the above-noted state, when the slide 602 further descends, a tip 501 of the male mold 500 presses the core 200 in the proximity of its joint face 201. Since a stress $\rho_2$ greater than the above-mentioned deformation resistance $\rho_1$ occurs in the proximity of the joint face 201 of the core, the portion causes plastic deformation and flows into the groove 102 of the boss 100. However, since the core 200 is restricted by the flat face portion 401 of the lower mold and by the flat face portion 302 of the upper keeper plate 300 except the portion facing the groove 102 of the boss 100 and its cylindrical portion 210, the core 200 is unable to cause plastic deformation. As the cylindrical portion 210 is spaced apart from the tip 501 of the male mold 500, no stress greater than the deformation resistance $\rho_1$ occurs there. Accordingly, the plastic deformation is limited only to an area near the joint face 201. It is thus possible to obtain a strong bonding power with a relatively small press force by causing a part of the core 200 to sufficiently flow into the groove 102.

When the aforementioned materials are employed for the core and the shaft, it is preferred that the prestress is from 5 to 15 kg/mm$^2$ and the stress $\rho_2$ is from about 150 to 180 kg/mm$^2$. When the outer diameter of the core 200 is 100 mm, therefore, the pre-load applied by the spring 604 is about 30 tons and the bonding load by the male mold 500 is from about 30 to about 40 tons. The tip 501 of the male mold 500 is machined in the annular shape so that the portion near the joint face 201 is uniformly pressed around the entire circumference. Hence, the axis of the boss 100 does not deviate from that of the core 200 during coupling.

Figure 7:
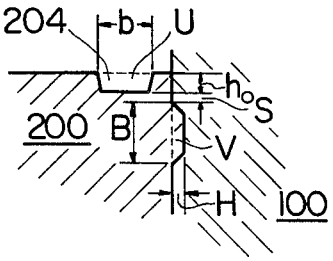
FIG. 7 is a schematic view explaining the dimensional relationship between the core and the boss portion in the present invention.

FIG. 7 provides an illustration of the details of a joint or coupling formed between the core 200 and boss 100. More particularly, as shown in FIG. 7, the core 200 has the recess 204 formed when it is pressed by the tip 501 of the male mold 500 and its depth h is preferably from 1 to 2 times the depth $H_o$ of the groove 102, or, preferably in the range of 0.6 to 1.0 Omm.

The volume U of the recess 204 should be so determined as to allow the sufficient inflow of a part of the core 200 into the groove 102.

To accomplish this object, the volume U must be the total of a volume corresponding to the volume V of the groove 102 plus a volume escaping to other portions, e.g., a volume of the core 200 extending outwardly in the radial direction. If a preload $\rho_0$ is applied to each of the upper and lower faces of the core, the escape volume to other portions can be relatively reduced. In such a case, the volume U may be in the range of 1.5 to 2.0 times the volume V. If the depth h of the recess is increased in order to obtain an increased volume U, the effective thickness of the core 200 becomes smaller at the joint portion and the concentration of stress occurs at that portion, thereby lowering the strength. If the distance S from the bottom of the recess 204 to the upper end of the groove 120 is extremely short or if the bottom of the recess 204 is positioned higher than the upper end of the groove 102, the bonding power is reduced. In other words, there occurs a tightening force, or the force of the material inserted into the groove 102 that tries to expand in both radial and axial directions. This tightening force restricts the shaft boss 100 and the core 200 at a predetermined position in cooperation with the groove 102 and the shear force obtained by knurling. If the abovementioned distance S is small, however, the tightening force is released and hence, the bonding power lowers. For this reason, there is a predetermined limit to the range of the depth h of the recess 204.

For the reasons not above, it is preferred to set the relationship between the width b of the recess 204 and the width B of the groove 102 to satisfy the following relationship.

$$0.5B \leqq b \leqq 1.5B$$

The recess 204 is preferably as close as possible to the joint face 201 of the core. If the recess 204 is far from the joint face 201, the material of the core 200 would excape upwardly and outwardly with respect to the radial direction at the time of pressing by the male mold 500 and the material could not be inserted effectively into the groove 102. In view of easy release of the tip 501 of the male mold 500, therefore, the recess 204 is preferably positioned considerably outward in the radial direction from the joint face 201.

It is preferred to keep the ratio S/b of the width b of the recess 204 to the distance S from the bottom of the recess 204 to an upper end of the groove 101 within a predetermined range.

Figure 8:
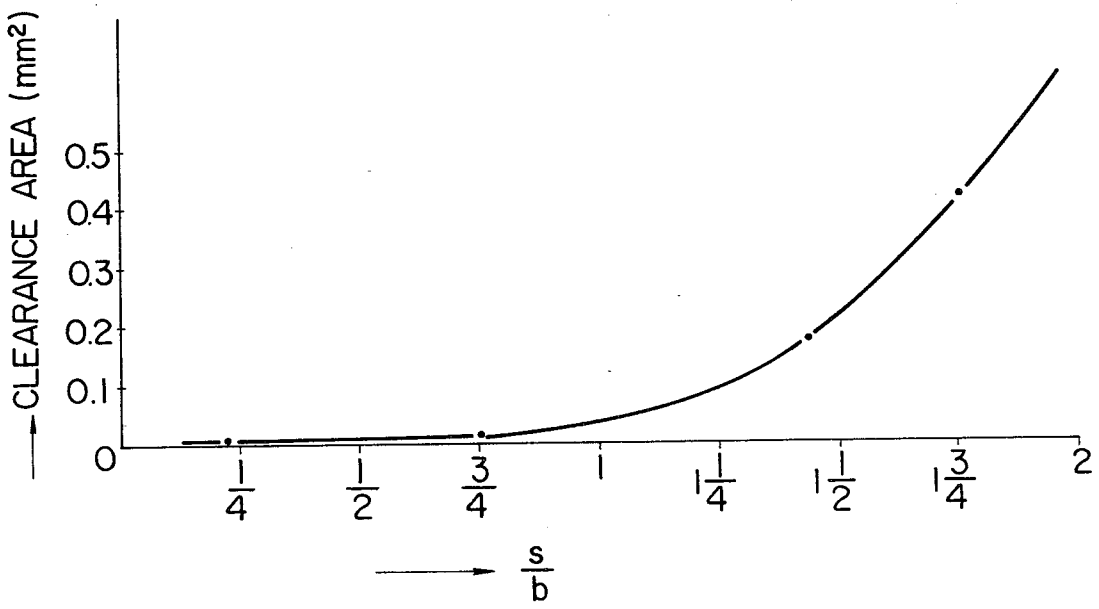
FIG. 8 is a diagram showing a relationship between a ratio S/b and a cross-sectional area of clearance area in the boss.

FIG. 8 provides a diagrammatic example of data of experiments carried out in order to determine the proper relationship between the ratio S/b and the cross-sectional area of the clearance formed inside the groove 102 due to insufficient fluidization at the time of coupling.

As shown in FIG. 8, the range where S/b is small, there is hardly any clearance except the angle portion of the groove 102. When S/b exceeds $\frac{3}{4}$, however, the clearance begins to appear on the bottom of the groove 102, and increases drastically when the distance the ratio exceeds 1. For, when S becomes greater, the distance becomes greater from the tip 501 of the male mold 500 to the upper end of the groove 102 and the frictional resistance of the material during its plastic deformation in this distance becomes also greater. Consequently, the internal stress of the material becomes greater and the other portions of the core 200 cause deformation such as its extension in the radial direction. The same result is observed when the pressing force is increased.

When the clearance inside the groove 102 becomes greater, the tightening force of the material inserted into the groove becomes smaller and the binding power lowers drastically. It is therefore preferred that the ratio of S/b is up to $\frac{3}{4}$.

On the other hand, when the distance S is less than zero, that is, when it is positioned deeper than the upper end of the groove 102, the tightening force of the material inserted into the groove 102 does not become greater and the binding power becomes weaker.

Taking all these matters into consideration, it is preferred that the ratio S/b satisfies the following relationship;

$$0 \leqq S/b \leqq \frac{3}{4}$$

As described hereinabove, in accordance with the coupling method of the present invention, the material is allowed to sufficiently flow into the groove 102 groove is provided with uneven portion so that the joint face 201 has large shear strength in the radial direction as well as in the axial direction, thereby providing a large bonding power. In the embodiment shown in FIG. 1, for example, if the outer diameter $D_1$ of the boss 100 on the joint face 101 is 28 mm, the transmission torque reaches as high as 90–100 Kg. This is about 3 times as large as the strength obtained by previously proposed coupling methods such as methods which apply direct knurling to the joint face of the shaft and presses the shaft into the hollow portion of the core 200. It is also easier in accordance with the present coupling method to bring the axis of the boss 100 into conformity with that of the core 200.

To prevent warp of a disc surface in coupling in shaft to a disc, it is effective to apply a pre-load to the entire end face of the disc before pressing it with the male mold 500.

Figure 9:
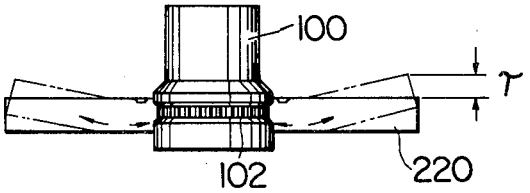
FIG. 9 is a schematic view of the boss and core illustrating the effect of the present invention.

For example, as shown in FIG. 9, if pressure is applied only by the male mold 500 without applying the pre-load, a warp $\tau$ occurs as indicated by broken line on the pressing side by the male mold 500. This warp $\tau$ is about 0.3–0.7 mm when the outer diameter D of the disc 220 is 100 mm. Preferably, a pre-load of $\Sigma\rho_o = 0.3 - 1.0\Sigma\rho_2$ is applied in order to prevent the warp $\tau$ and to allow easy and effective insertion of the material into the groove 102.

Figure 10:
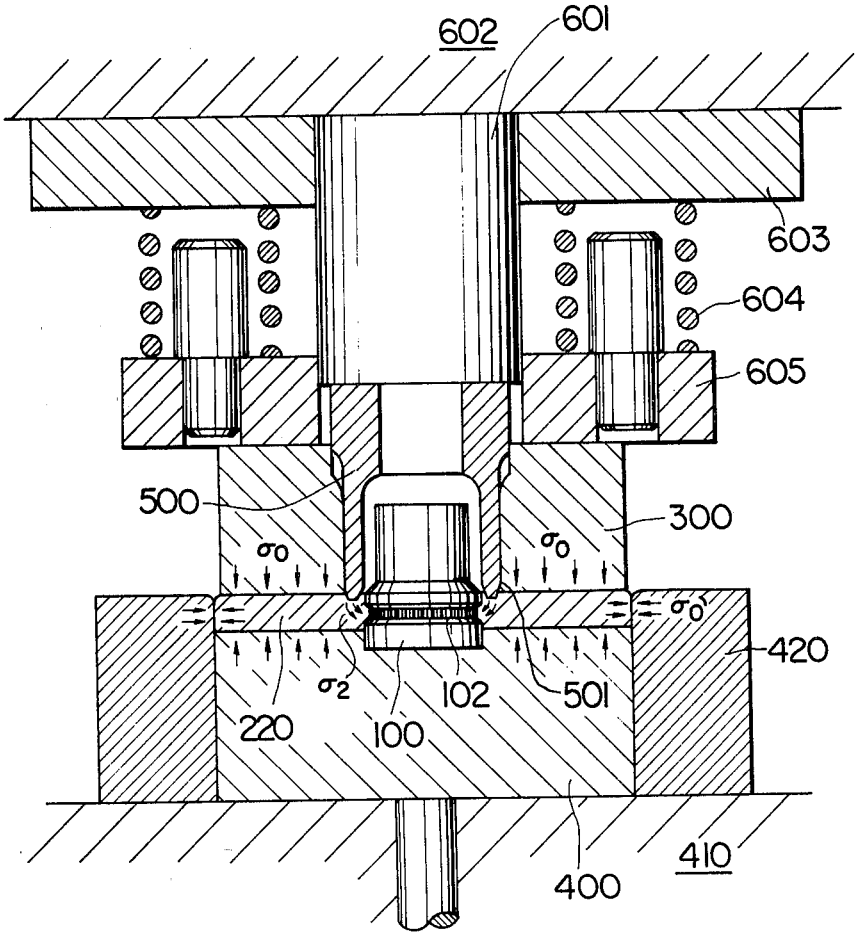
FIG. 10 shows another embodiment of the coupling apparatus of the present invention.

As shown in FIG. 10, an external mold 420 is employed in order to restrict the disc 220 not only on its upper and lower faces but also around its outer circumference by causing pre-stress $\rho_{0'}$. Since the disc 220 is restricted over its entire face, the material is caused to perfectly flow into the groove 102 when pressed by the tip 501 of the male mold 500.

The constructional arrangement described hereinabove is especially effective in cases wherein the areas of the upper and lower faces of the disc 220 are small and hence, sufficient restriction force can not be obtained only by the keeper plate 300 and by the resiliency of the springs 604.

Figure 11:
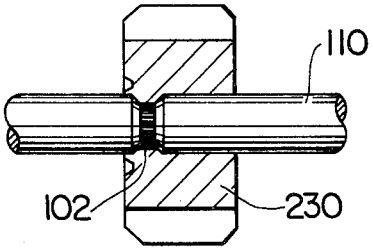
FIG. 11 is a longitudinal cross-sectional view of a gear coupled to a shaft by the coupling method of the present invention.

FIG. 11 provides an example of a method of the present invention for coupling a gear 230 and a shaft 110. The material of the gear 230 is high carbon steel which is relatively easy to cause plastic deformation, and only the tooth portion close to the outer circumference is subjected to the hardening treatment.

Figure 12:
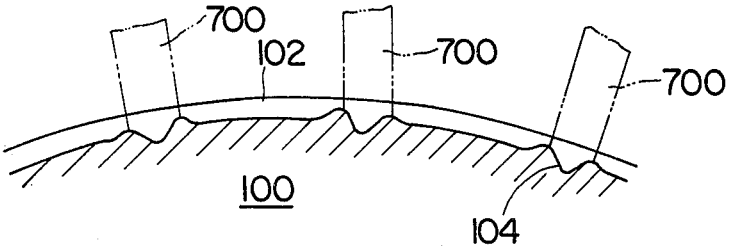
FIG. 12 is a transverse sectional view illustrating a machining process in accordance with still another embodiment of the present invention.

FIG. 12 provides another example of a groove shape for coupling in accordance with the present invention, as shown in FIG. 12, uneven portions 104 are formed intermittently on the bottom of the groove 102. These uneven portions 104 are machined by first machining the groove 102, arranging equidistantly punches 700, and simultaneously applying a load to all the punches 700.

Figure 13:
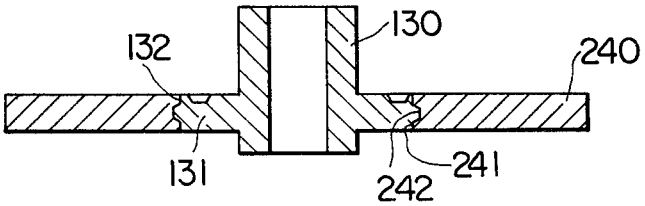
FIG. 13 is a cross-sectional view still another embodiment of the present invention adapted to the coupling of a boss and a disc.

FIG. 13 shows still another embodiment of the invention adapted to the case where a material having large deformation resistance such as a disc brake sheet is positioned outside of a shaft or boss member.

As shown in FIG. 13, a hollow disc 240 made of stainless steel, is provided with a groove 232 having uneven portions on a joint face 241. A hollow shaft 130, made of mild steel, is provided with a flange 131 along an outer periphery thereof which serves as the joint face 132. In this embodiment, the flange 131 of the hollow shaft 130 is pressed to cause plastic deformation and is then coupled to the hollow disc 240.

Besides the embodiments described above, the present invention can be adapted to the mutual coupling of various metallic members having varying shapes such as a shaft, a cylinder, a disc, a cup-like sheet and so on the joint face of a cylindrical shape.

What is claimed is:

1. A method of coupling a first metallic member and a second metallic member, the method comprising the steps of:

forming a circumferentially extending groove in a joint face of the first metallic member;

forming uneven portions along a bottom of the groove;

assemblying the first metallic member and second metallic member by disposing the joint face of the first metallic member substantially concentrically with a joint face of the second metallic member;

applying an actual annular prestress to the second metallic member at least in a vicinity to be cold worked; and then cold working an annular portion of the second metallic member with a first work member in a vicinity of the joint face so as to cause a plastic deformation and cause a portion of the second metallic member to fluidize and flow into the groove while applying said actual prestress to the second metallic member at least in a vicinity of said cold work portion by a second work member separate from said first work member for the colding working so as to prevent substantial flow of the second metallic member except into the groove, thereby coupling the first metallic member to the second metallic member.

2. A method according to claim 1, wherein the step of forming uneven portions includes knurling the bottom of the groove.

3. A method according to claim 2, wherein the step of forming the groove includes machining the groove to a depth of from 0.2 to 1.0 mm.

4. A method according to one of claims 2 or 3, wherein the knurling forms uneven portions having a height of between 0.2 to 1.0 mm.

5. A method according to one of claims 1, 2 or 3, wherein the second metallic member is formed of a material having a smaller deformation resistance than the first metallic member.

6. A method according to claim 5, wherein the first metallic member is a cylindrical member and the second metallic member is a sheet-like member with a central opening therein telescoped over the cylindrical member, and wherein the applying of an actual prestress includes compressing both sides of the sheet-like member between a pair of surfaces including the second work member.

7. The method according to claim 6, wherein the step of cold working includes pressing the second metallic member circumferentially around a joint surface.

8. A method according to claim 6, wherein the prestress is applied to a pair of major surfaces of the sheet-like second metallic member.

9. A method according to claim 6, wherein the prestress and position at which the prestress is applied are selected to prevent the sheet-like second metallic member from substantial warping.

10. A method according to claim 5, wherein the first metallic member is one of a shaft and a boss and the second metallic member is one of a disc and a cup-shaped sheet member, the second metallic member being telescoped over the first metallic member, the cup-shaped sheet member includes a radial disc portion having a central opening therein and a cylindrical side wall, and wherein the applying of an actual prestress includes compressing the sides of the second metallic member between a pair of surfaces including the second work member.

11. A method according to claim 1, wherein the prestress is smaller than a deformation resistance of the second metallic member.

12. A method according to claim 11, wherein the step of cold working includes pressing a mold against the second metallic member in the vicinity of the joint face.

13. A method according to claim 12, wherein the step of forming uneven portions includes knurling the bottom of the groove.

14. A method according to claim 13, wherein the step of forming the groove includes machining the groove to a depth of from 0.2 to 1.0 mm.

15. A method according to one of claims 12 or 13, wherein the first metallic member is of a cylindrical configuration and the second metallic member is of a sheet-like configuration.

16. A method according to claim 11, wherein the prestress is in the range of 5 to 15 kg/mm$^2$.

17. A method according to claim 1, wherein the step of forming the uneven portions includes arranging a plurality of punches at equal distances about a periphery of the groove, and simultaneously applying a load to all of the punches to form the uneven portions in the groove.

18. A method according to claim 1, wherein the step of cold working includes forming a recess having a predetermined width in the second metallic member in a vicinity of the joint face with a bottom of the recess being spaced from an upper end of the groove by a predetermined distance.

19. A method according to claim 18, wherein a ratio of the predetermined width of the recess to the predetermined distance is in the range of 0 to 1.

20. A method according to claim 19, wherein the ratio is $\frac{3}{4}$.

21. A method of coupling a first metallic member and a second metallic member, the method comprising the step of:

forming a circumferentially extending groove in a joint face of the first metallic member;

assemblying the first metallic member and second metallic member by disposing the joint face of the first metallic member substantially concentrically with joint a face of the second metallic member;

applying an actual annular prestress to the second metallic metallic member at least in a vicinity to be cold worked; and then cold working an annular portion of the second metallic member with a first work member in a vicinity of the joint face so as to cause a plastic deformation and cause a portion of the second metallic member to fluidize and flow into the groove while applying said actual prestress to the second metallic member at least in a vicinity where said cold working is effective by a second work member separate from said first work member so as to substantially prevent an influencing of said cold working to the second metallic member except for a flow of the second metallic member into the groove thereby coupling the first metallic member to the second metallic member.

* * * * *